US005799339A

United States Patent [19]

Perry et al.

[11] Patent Number: 5,799,339

[45] Date of Patent: Sep. 1, 1998

[54] SAFETY COVER FOR SPA SUCTION DRAIN

[75] Inventors: Loren Perry, Fountain Valley; Darrin Swanson, Simi Valley, both of Calif.

[73] Assignee: American Products, Moorpark, Calif.

[21] Appl. No.: 731,659

[22] Filed: Oct. 17, 1996

[51] Int. Cl.[6] ..... A47K 1/14

[52] U.S. Cl. ..... 4/286; 4/496

[58] Field of Search ..... 4/286, 288, 290, 4/292, 541.1, 496, 559, 507

[56] References Cited

U.S. PATENT DOCUMENTS

| | | | |
|---|---|---|---|
| D. 286,319 | 10/1986 | Mathis . | |
| D. 290,166 | 6/1987 | Jacuzzi . | |
| D. 299,522 | 1/1989 | Chalberg . | |
| D. 319,295 | 8/1991 | Ohaus . | |
| D. 327,534 | 6/1992 | Manville et al. . | |
| D. 333,342 | 2/1993 | Newhard . | |
| D. 343,228 | 1/1994 | Colin . | |
| D. 344,325 | 2/1994 | Chalberg . | |
| 951,795 | 3/1910 | Berwanger | 4/292 |
| 3,378,858 | 4/1968 | Jacuzzi . | |
| 3,932,281 | 1/1976 | Pansini . | |
| 4,170,047 | 10/1979 | Corsette et al. . | |
| 4,321,713 | 3/1982 | Thompson | 4/286 |
| 4,359,790 | 11/1982 | Chalberg . | |
| 4,525,273 | 6/1985 | Logsdon . | |
| 4,658,449 | 4/1987 | Martin . | |
| 4,676,894 | 6/1987 | Diamond et al. . | |
| 5,167,041 | 12/1992 | Burkitt, III . | |
| 5,217,292 | 6/1993 | Chalberg . | |
| 5,341,523 | 8/1994 | Barnes | 4/507 |
| 5,347,664 | 9/1994 | Hamza et al. | 4/292 |

*Primary Examiner*—David J. Walczak

*Attorney, Agent, or Firm*—Pretty, Schroeder & Poplawski

[57] ABSTRACT

A safety cover for mounting upon a suction drain that removes water from a jetted tub or spa. The safety cover can handle a high fluid flow intake rate and has a relatively small size, yet is unlikely to entangle the hair of a user and can pass the industry standard five pound pull test. The safety cover has at least one internal wall that acts as a guide vane thereby advantageously tending to reduce turbulence and vortexing of the water as it passes through the cover and into the suction drain. Because turbulence and vortexing of the water is reduced, the possibility that a user's hair could extend through the cover and become entangled thereunder is likewise reduced. Further, because of the stabilized fluid flow inside the safety cover, the cover can have a size that is smaller than otherwise possible without the anti-vortexing interior wall. The interior wall also can extend from the cover to a supporting base to advantageously increase the structural strength of the cover.

13 Claims, 3 Drawing Sheets

FIG. 5
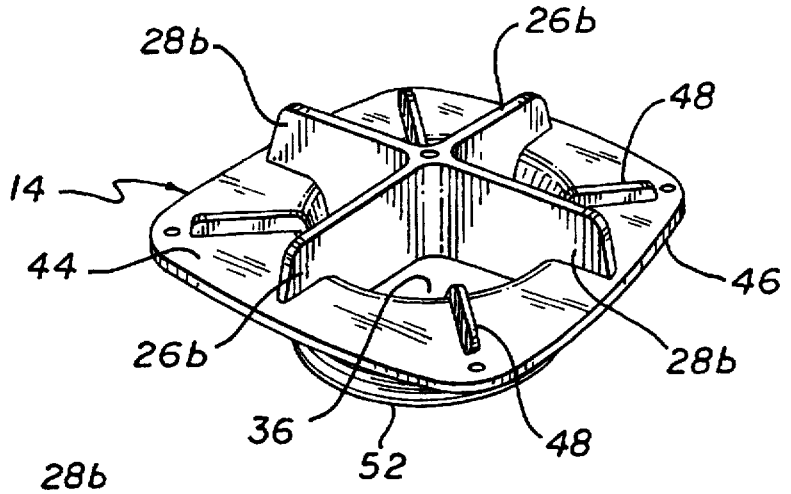
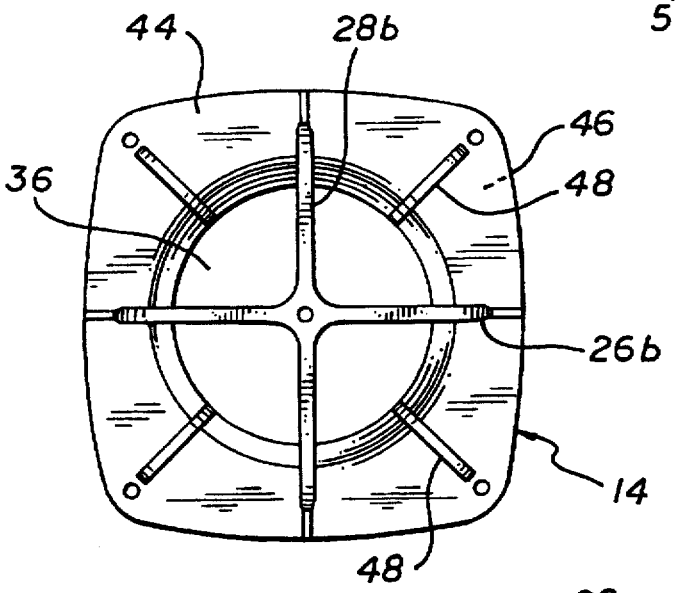
FIG. 6
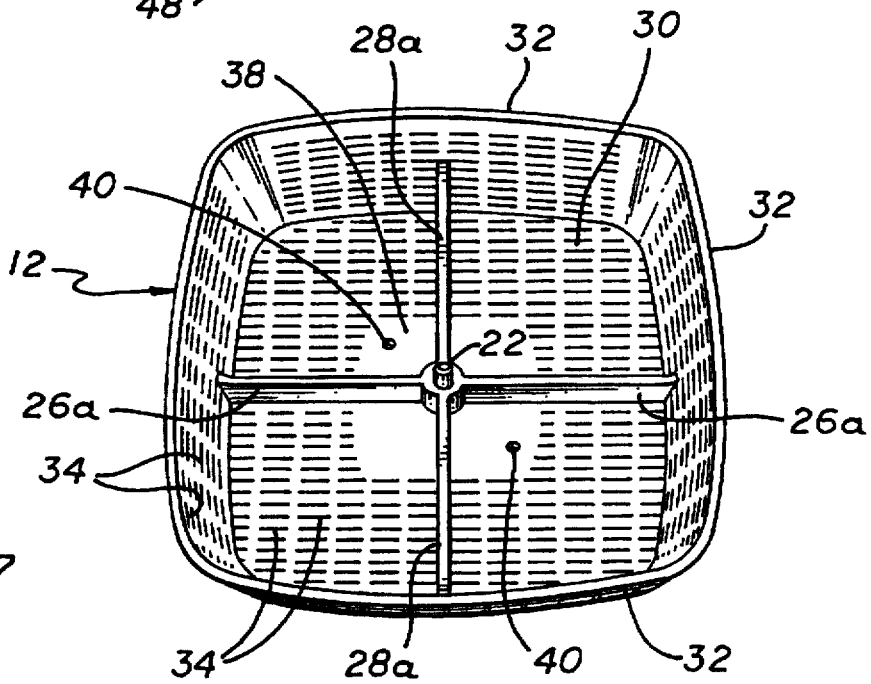
FIG. 7

SAFETY COVER FOR SPA SUCTION DRAIN

BACKGROUND OF THE INVENTION

The invention relates generally to suction fittings for use with water circulating pumps in spas and tubs, and, more particularly, to high flow suction fittings that have safety features to assure the safety of the user of the spa or tub.

Jetted tubs and spas are generally equipped with pumps for the circulation of water. A typical spa or tub has a recessed inside surface for holding a body of water. Below the water line, a suction drain and a number of jet nozzles are mounted on the inside surface of the spa. In operation, the pump draws water through the suction drain and expels pressurized water through the jet nozzles for the comfort and enjoyment of the user. To prevent objects from becoming lodged or entrapped in suction drains covers for such drains, also known as suction fittings, have been developed. Suction fittings of this general type are described in U.S. Pat. No. 4,676,894 and U.S. Pat. No. 5,347,664, which is owned by the assignee of the present invention, American Products, Inc. of Moorpark, California. While these suction fittings work acceptably in most situations, they have some drawbacks under certain conditions.

The purpose of the suction fitting is to safely draw water from the body of water in the spa in a manner that minimizes the likelihood that the body or hair of the user will become entrapped by the fitting when the fitting is operated within the manufacturer's rating for the device. To assure the safe operation of suction fittings, they are tested to meet a national standard requiring that each particular fitting be rated at 80% of the flow rate at which a force of five pounds or less will remove a mass of human hair placed against the fitting. This test will hereafter be referred to as the "five pound pull test." Suction fittings are also tested to ensure that their structure is strong enough to withstand forces greater than those typically encountered in normal use. As determined by the five pound pull test, the typical flow rating of the above identified suction fittings has generally been less than 100 gallons per minute.

As jetted tubs and spas have become more popular, customers have demanded jetted tubs with as many as fifty jet nozzles, thus necessitating larger circulation systems capable of providing a significantly increased water flow to supply the increased number of jet nozzles. These larger circulation systems require suction fittings that have higher flow ratings of approximately 200 gallons per minute. In addition, while there is a need for suction fittings with higher flow ratings, it is also preferable to minimize the size of the suction fittings to avoid obstructing the inside of the tub and so that the fitting will fit within the area provided by the manufacturer for the mounting of a suction fitting inside of the tub. However, conventional suction fittings cannot pass the five pound pull test under the high flow rates required by the newer jetted tubs. In particular, when a conventional fitting is operated under a high flow rate, the water flow inside of the fitting can become turbulent or can vortex like a tornado. When the water flow through such a fitting becomes turbulent or vortexes, hair extending through the cover of the fitting can become entangled within the fitting, thereby rendering the hair difficult to remove from the fitting. Accordingly, the conventional fitting cannot pass the five pound pull test at high flow rates.

In light of the drawbacks described above, manufacturers have resorted to using two or more conventional suction fittings in a jetted tub. This results in increased manufacturing cost for the extra fitting and the plumbing it requires.

In addition, the extra fitting takes up more space inside the tub, thereby providing another obstruction that reduces the space available to the user of the tub.

It should therefore be appreciated that there is a need for a safety cover for a suction drain in a jetted spa or tub that has a high flow rate and a relatively small size and that can pass the five pound pull test described above. The present invention fulfills this need.

SUMMARY OF THE INVENTION

The present invention provides a safety cover for a suction drain in a jetted spa or tub. The safety cover can handle a high flow rate and has a relatively small size that can pass the industry standard five pound pull test described above. The safety cover has an internal wall acting as a guide vane that advantageously tends to prevent the vortexing of the water as it passes through the cover and into the suction drain. Because vortexing of the water is reduced, the possibility that a user's hair could become entangled under the cover adjacent to the suction drain is likewise reduced. Further, because of the reduced tendency of the water to vortex inside the cover, the cover can have a size that is smaller than otherwise possible without the anti-vortexing guide vane. The guide vane also can advantageously increase the structural strength of the cover.

More particularly, the invention provides a safety cover for a suction drain in a jetted spa or tub that is intended to reduce the risk that an occupant's hair or other objects could become entangled within a water stream entering the drain. The safety cover has a base, a fastener, a cover, and an interior wall shaped to act as a flow-directing vane. The base is mountable to an interior surface of the tub or spa and has a central opening which communicates with the suction drain. The base extends generally parallel to the underlying spa surface and has a peripheral edge. The cover has a face wall spaced from the base and a sidewall extending from the face wall. The sidewall of the cover has a free peripheral edge contacting the base in the region of its periphery to define a closed chamber enclosing the opening in the base. The face wall and sidewalls are perforated to act as a screen in the way of entry of hair into the chamber. The fastener connects the face wall to the base to draw the cover into secure contact against the base. The interior wall is mounted within the chamber and is shaped to act as a flow directing vane with respect to water entering the chamber and passing through the opening in the base to the suction drain to resist the development of a water vortex within the chamber. The perforated character of the walls and the water flow across the interior wall within the chamber resist entrapment of the occupant's hair within the water stream entering the suction drain. Thus, the vane advantageously reduces vortexing and turbulence within the chamber to provide the advantages identified above.

In a more detailed feature of the invention, the total area of the holes in the sidewalls is greater than that of the holes in the face wall, which can be, in turn, greater than the area of the hole in the base that connects to the suction drain. In yet more detailed aspects of the invention, the interior wall can be located so that it does not obstruct the holes in the cover and can extend between the cover and the base to provide additional structural support to the cover. In a further detailed aspect of the invention, another interior wall can be provided to further reduce turbulence and vortexing of the water within the chamber between the cover and the base.

A method of preventing the entanglement of hair extending through a perforated cover into a suction drain of a jetted tub or spa is also provided. The cover mates with a base having a hole aligned with the suction drain to define a chamber therebetween. An interior wall is mounted in the chamber to act as a guide vane for the water, thereby reducing the tendency of the water to vortex. More particularly, the method comprises the steps of drawing water into the suction drain and drawing water through the cover and across the interior wall. The interior wall tends to guide the water directly through the cover and into the suction drain to reduce vortexing or turbulence that would entangle the hair extending through the cover toward the suction drain.

Other features and advantages of the present invention will become apparent from the following description of the preferred embodiment, taken in conjunction with the accompanying drawings, which illustrate, by way of example, the principles of the invention.

BRIEF DESCRIPTION OF THE DRAWINGS

The following drawings illustrate the preferred embodiment of the invention. In such drawings.

Figure 1:
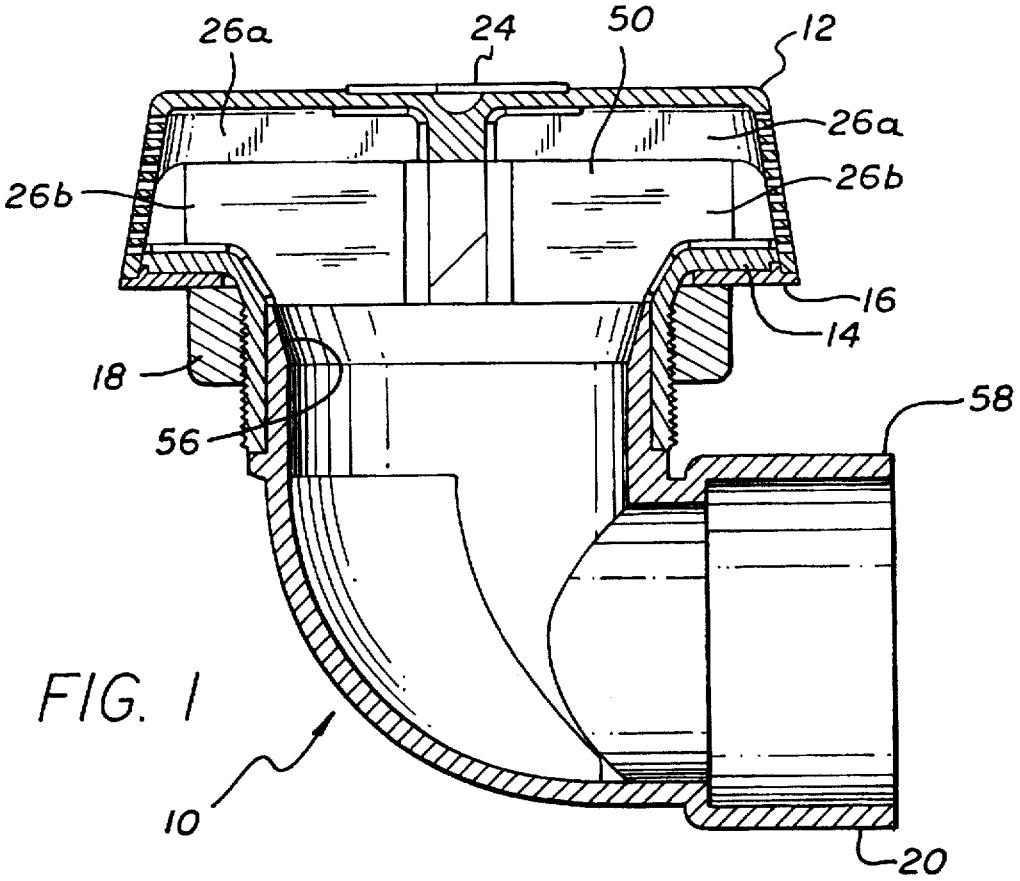
FIG. 1 is a cross sectional view of a safety cover of this invention.

FIG, 5 is a perspective view of the base of the safety cover of FIG. 1;

FIG. 6 is a top plan view of the base of FIG. 5; and

FIG. 7 is a perspective view of the cover of the safety cover of FIG. 1.

DESCRIPTION OF THE PREFERRED EMBODIMENT

Figure 2:
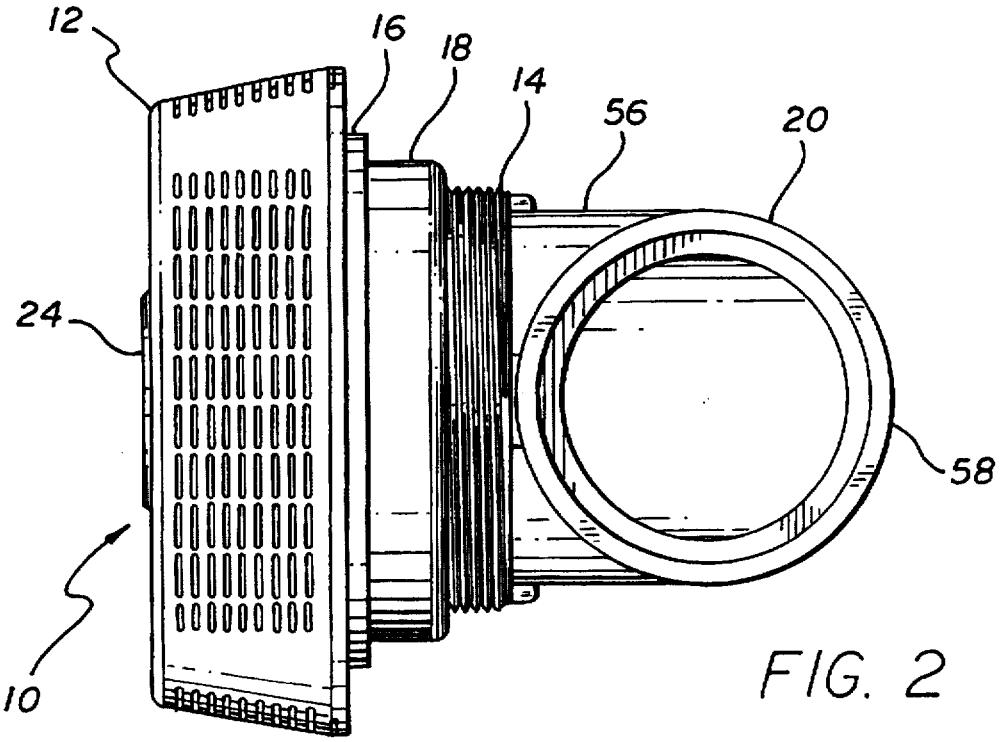
FIG. 2 is a side view of the safety cover of FIG. 1.
Figure 3:
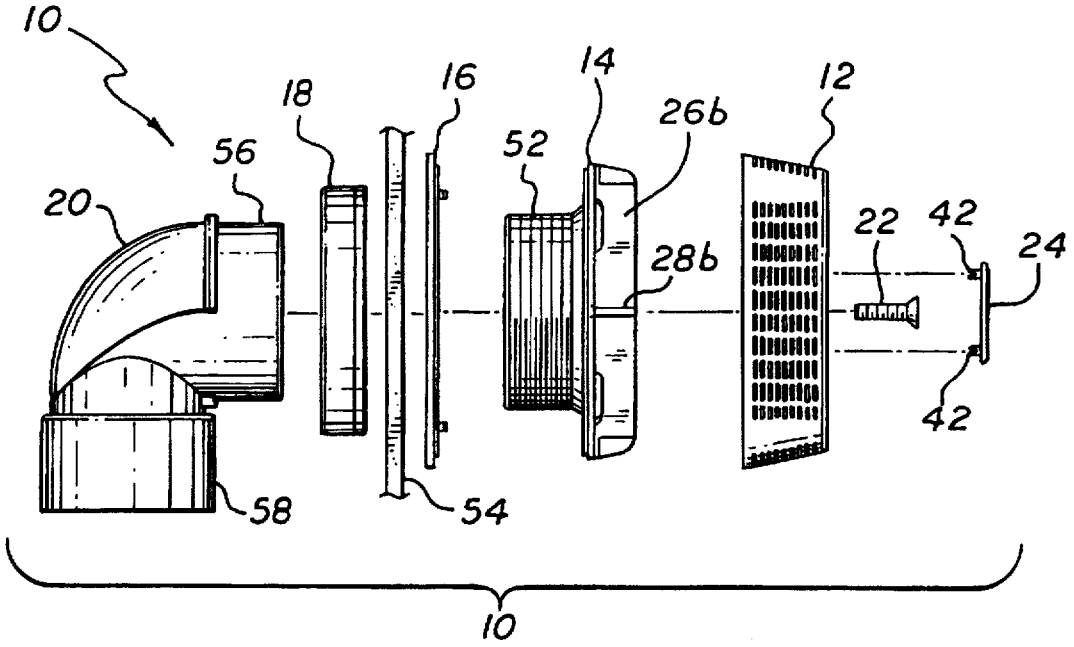
FIG. 3 is an exploded side view of the safety cover of FIG. 1.

With reference now to the drawings, and particularly FIGS. 1, 2 and 3, the present invention is preferably embodied in a safety cover assembly for a suction drain in a jetted tub or spa. The safety cover assembly is generally referred to by the reference numeral 10, and includes a cover 12, a threaded base 14, a gasket 16, a threaded collar 18, an elbow fitting 20, a stainless steel screw 22 and a name plate 24. As will be described below, the cover 12 and the base 14 have interior walls that act as cooperating guide vanes 26*a,b* and 28*a,b* to advantageously reduce turbulence and vortexing of the water passing through the safety cover assembly 10. Thus, the guide vanes 26*a,b* and 28*a,b* allow the safety cover assembly 10 to handle high flow rates of approximately 200 gallons per minute while simultaneously reducing the likelihood that hair from a user will become tangled inside the cover assembly 10. The guide vanes 26*a,b* and 28*a,b* enable the safety cover assembly 10 to have a relatively small size and yet pass the five pound pull test at high flow rates. The guide vanes 26*a,b* and 28*a,b* also advantageously increase the structural integrity of the safety cover assembly 10.

Figure 4:
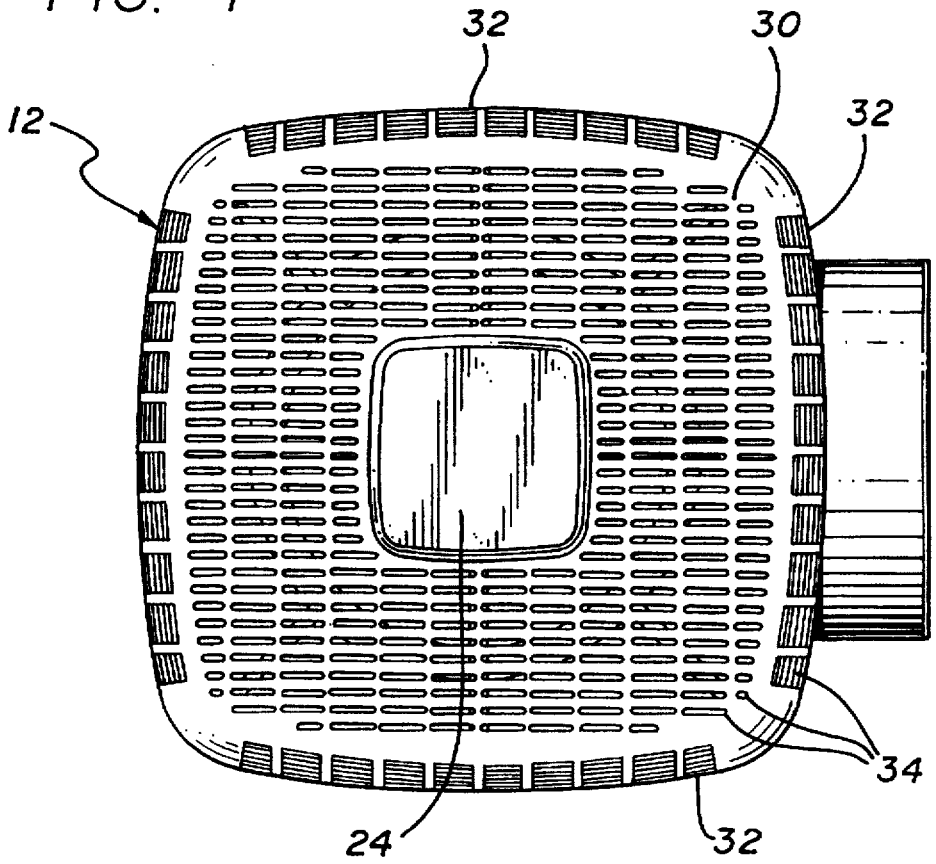
FIG. 4 is a front view of the safety cover of FIG. 1.

The cover 12 of the preferred assembly 10 has a generally square face wall 30 and four sidewalls 32 (collectively referred to as sidewall), all with holes 34 formed therein for water flow therethrough (FIGS. 4 and 7). The total area of the holes 34 in the sidewalls 32 is greater than that of the holes 34 in the face wall 30, which are, in turn, greater than the area of a hole 36 in the base 14, which mates with a suction drain. The holes 34 in the cover 12 are arranged in the aforementioned manner so that the water flow through the cover 12 is uniformly low, thereby reducing the suction force adjacent to the cover 12 and reducing the likelihood that the suction force will cause an object to become lodged against either the face wall 30 or sidewalls 32 of the cover 12.

Because the center 38 of the face wall 30 is an area that would have a high fluid intake flow, the center 38 of the face wall 30 is solid. This solid center section 38 evens out the water flow across the rest of the face wall 30 so that there are no areas of high flow that would create unwanted areas of high suction force. Two holes 40 are formed in the center portion 38 of the face wall 30 to accept pins 42 on the name plate 24 (FIG. 3). Now that the holes 34 in the cover 12 have been described, the structure on the underside of the cover 12 will now be described.

Guide vanes 26*a* and 28*a* are integrally formed on the underside of the cover 12 (FIGS. 1 and 7). The guide vanes 26*a* and 28*a* are at right angles to each other and extend between opposite sidewalls 32 of the cover 12. The guide vanes 26*a* and 28*a* do not obstruct any of the holes 34 formed in the face and sidewalls of cover 12. This advantageously prevents hair from entering the same hole and becoming entangled by wrapping around both sides of a guide vane. Where the guide vanes 26*a* and 28*a* intersect, a hole through the cover 12 is provided for the mounting screw 22. The two guide vanes 26*a* and 28*a* on the underside of the cover 12 are sized to engage with and align with the guide vanes 26*b* and 28*b* on the base 14, which are described below.

Guide vane 26*a* extends from the face wall 30 of the cover 12 toward base 14. Guide vane 26*a* intersects with the guide vane 28*a* to divide the cover 12 into four portions. The total area of the holes 34 in each portion of the cover 12 equals the total area of the holes 34 in each other portion of the cover 12. Each portion of the cover 12 includes a portion of the face wall 30 and a portion of the sidewall 32 of the cover 12. The total area of the holes in the portion of the sidewall 32 being greater than the total area of the holes in the portion of the face wall 32.

The preferred base 14 has a generally square upper surface 44 with a peripheral edge 46, the central hole 36, reinforcing ribs 48, and the two guide vanes 26*b* and 28*b* (FIGS. 5 and 6). The upper surface 44 of the base 14 is sized to mate with the sidewalls 32 of the cover 12 to form a fluid intake chamber 50 inside of the assembly 10, between the cover 12 and the base 14. The reinforcing ribs 48 extend diagonally from each corner of the base 14 and tend to prevent cracking of the base 14 when it is installed in a jetted tub or spa. The guide vanes 26*b* and 28*b* are integrally formed on the base 14 and extend across the central hole 36 in a perpendicular orientation. The guide vanes 26*b* and 28*b* of the base 14 are sized to align with and abut the guide vanes 26*a* and 28*a* formed on the underside of the cover 12 (FIG. 1). The guide vanes 26*a,b*, 28*a,b* divide chamber 52 into four subchambers. The base 14 has an externally threaded end 52 sized to threadedly engage the collar 18 to mount the assembly 10 to the wall 54 of a jetted tub or spa (FIG. 3). The gasket 16 is sized to fit around the threaded end 52 of the base 14 and abut the rear surface of the base 14. The wall 54 of the jetted tub would be located between this gasket 16 and the threaded collar 18. The gasket 16 can be made of an elastomeric material to cushion impacts upon the fitting 10. With the exception of the screw 22, the remainder of the components of the assembly 10 can be made of ABS plastic or polycarbinate material by well known injection molding techniques.

A first end 56 of the elbow fitting 10 fits inside the collar 18 and can be attached by adhesive, as is well known in the art. The other end 58 of the elbow fitting 10 can be connected to a suction drain of a water circulation system that requires a relatively high rate of intake water flow.

The operation of the preferred safety cover assembly 10 will now be described (FIG. 1). Water enters the cover 12 and passes along the guide vanes 26*a,b* and 28*a,b* inside the fluid intake chamber 50. Despite the high flow rate, the guide vanes 26*a,b* and 28*a,b* guide the water directly toward the suction drain, thereby tending to reduce turbulence and vortexing of the water so that it moves straight through the cover 12, the chamber 50 of the assembly 10 and out through the central hole 36 in the base 14. Thus, the water flow through the assembly 10 is not likely to vortex and entangle a user's hair inside the chamber 50 of the assembly 10. Further, by virtue of the flow provided by the guide vanes 26*a,b* and 28*a,b*, the cover 12 can be made smaller than otherwise possible, thereby resulting in a safety cover assembly 10 that easily fits within tubs and spas and does not unduly obstruct the inside of tubs and spas. In particular, without the guide vanes 26*a,b* and 28*a,b*, the cover 12 would have to be substantially larger so that hair extending through the cover would be safely away from the turbulent hole 36 in the base 14.

While a particular form of the invention has been illustrated and described, it will be apparent that various modifications can be made without departing from the spirit and scope of the invention. Accordingly, it is not intended that the invention be limited, except as by the appended claims.

We claim:

1. A safety cover for a suction drain in a jetted spa or tub intended to reduce the risk that an occupant's hair could become entangled within a water stream entering the drain, comprising:

a base mountable to an interior surface of the tub or spa, the base having a central opening which communicates with the suction drain, said base extending generally parallel to the underlying spa surface and having a peripheral edge;

a cover having a face wall spaced from the base and a sidewall extending from the face wall and having a free peripheral edge contacting said base in the region of its periphery to define a closed chamber enclosing said opening, said face wall and sidewall being perforated to act as a screen in the way of entry of hair into the chamber;

a fastener connecting said face wall to said base to draw said cover into secure contact against said base;

an interior wall mounted within said chamber and shaped to act as a flow directing vane with respect to water entering the chamber and passing through the opening to the suction drain to resist the development of a water vortex within said chamber, wherein the perforated character of said walls and the water flow across said interior wall within said chamber resist entrapment of the occupant's hair within the water stream entering the suction drain; and a second interior wall forming another vane extending from the face wall of said cover toward said base, wherein said second interior wall intersecting with said first interior wall to divide said cover into four portions, the total area of the holes in each portion of said cover equaling the total area of the holes in each other portion of said cover.

2. The safety cover of claim 1, wherein said interior wall projects from the face wall of said cover toward said base.

3. The safety cover of claim 2, wherein said interior wall does not obstruct the perforations in said cover.

4. The safety cover of claim 1, wherein each portion of said cover includes a portion of the face wall of said cover and a portion of the sidewall of said cover, the total area of the holes in the portion of the sidewall being greater than the total area of the holes in the portion of the face wall.

5. The safety cover of claim 1, wherein said interior wall is aligned along a plane that is parallel to an axis of the central opening in said base.

6. The safety cover of claim 1, wherein the total area of the holes in the sidewall of said cover is greater than the total area of the holes in face wall of said cover, and wherein the total area of the holes formed in the face wall of said cover is greater than the area of the central opening in said base.

7. The safety cover of claim 1, wherein said interior wall extends from the face wall of said cover to the base.

8. The safety cover of claim 7, wherein said interior wall is made up of two portions, one integrally formed in the face wall and the other integrally formed in said base.

9. A method of preventing the entanglement of hair extending through a perforated cover into a suction drain of a jetted tub or spa, the cover mating with a base having a hole therein aligned with the suction drain to define a chamber therein, an interior wall mounted within the chamber to act as a guide vane, another interior wall mounted within said chamber to divide the chamber into four portions the method comprising the steps of:

drawing water into the suction drain; and drawing water through the cover and across the interior wall, the interior wall tending to guide the water directly through the suction fitting and reduce vortexing that would entangle the occupant's hair extending through the perforated cover toward the suction drain.

10. The method of claim 9, wherein the interior wall extends from the cover to the base inside of said chamber.

11. A safety cover assembly for reducing the turbulence of water passing through the safety cover assembly into a suction drain, the safety cover assembly comprising:

a base having a central opening in communication with the suction drain;

a cover including a face wall spaced from the base and including a sidewall extending from the face wall, the base configured to mate with the sidewall to form a chamber between the cover and the base, wherein at least the face wall or the sidewall having holes therethrough to allow passage of water through the safety cover assembly into the suction drain;

at least one interior wall dividing the chamber into a plurality of subchambers, each subchamber allowing passage of water through the safety cover assembly into the suction drain, wherein the at least one interior wall includes a first guide vane integrally formed on the cover and projecting from the face wall towards the base and a second guide vane integrally formed on the base and projecting towards the face wall, wherein the second guide vane is configured to align with and abut the first guide vane.

12. A safety cover assembly for reducing the turbulence of water passing through the safety cover assembly into a suction drain, the safety cover assembly comprising:

a base having a central opening in communication with the suction drain;

a cover including a face wall spaced from the base and including a sidewall extending from the face wall, the base configured to mate with the sidewall to form a chamber between the cover and the base, wherein at least the face wall or the sidewall having holes therethrough to allow passage of water through the safety cover assembly into the suction drain; and at least one interior wall dividing the chamber into a plurality of subchambers, each subchamber allowing passage of water through the safety cover assembly into the suction drain, wherein the at least one interior wall includes a first interior wall and a second interior wall, wherein the first interior wall and the second interior wall intersect to divide the chamber into four subchambers.

13. A safety cover assembly for reducing the turbulence of water passing through the safety cover assembly into a suction drain, the safety cover assembly comprising:

a base having a central opening in communication with the suction drain;

a cover including a face wall spaced from the base and including a sidewall extending from the face wall, the base configured to mate with the sidewall to form a chamber between the cover and the base, wherein at least the face wall or the sidewall having holes therethrough to allow passage of water through the safety cover assembly into the suction drain; and at least one interior wall dividing the chamber into a plurality of subchambers, each subchamber allowing passage of water through the safety cover assembly into the suction drain; wherein the at least one interior wall extends from the face wall to the base and has each of its opposing ends abutting the sidewall.

* * * * *